US005625390A

United States Patent [19]

Burke et al.

[11] Patent Number: 5,625,390

[45] Date of Patent: Apr. 29, 1997

[54] PAIRING OF INK DROPS ON A PRINT MEDIUM

[75] Inventors: Edward F. Burke, Lake Oswego; Mark R. Parker, Portland; David D. Martenson, Milwaukie, all of Oreg.

[73] Assignee: Tektronix, Inc., Wilsonville, Oreg.

[21] Appl. No.: 381,615

[22] Filed: Jan. 30, 1995

[51] Int. Cl.[6] ..... B41J 2/145; B41J 2/15

[52] U.S. Cl. ..... 347/41; 347/40

[58] Field of Search ..... 347/40, 41, 43

[56] References Cited

U.S. PATENT DOCUMENTS

| | | | |
|---|---|---|---|
| 4,920,355 | 4/1990 | Katerberg | 347/41 |
| 4,967,203 | 10/1990 | Doan et al. . | |
| 4,999,646 | 3/1991 | Trask . | |
| 5,070,345 | 12/1991 | Lahut et al. . | |
| 5,075,689 | 12/1991 | Hoisington et al. . | |
| 5,079,571 | 1/1992 | Eriksen | 347/43 |
| 5,170,416 | 12/1992 | Goetz et al. . | |
| 5,239,312 | 8/1993 | Merna et al. . | |
| 5,300,950 | 4/1994 | Lopez et al. . | |
| 5,300,957 | 4/1994 | Burke . | |

FOREIGN PATENT DOCUMENTS

| | | |
|---|---|---|
| 0476860 | 3/1992 | European Pat. Off. . |

*Primary Examiner*—Benjamin R. Fuller
*Assistant Examiner*—Thinh Nguyen
*Attorney, Agent, or Firm*—Ralph D'Alessandro

[57] ABSTRACT

An image transfer ink-jet printer employs an image receiving drum that rotates relative to an ink-jet array print head spanning the full width of the drum. A print head positioner moves the print head in precise increments to position adjacent scan lines of ink drops. Without affecting the overall scale of the image, adjacent pairs of scan lines are spaced at distances less than one nominal pixel width. Pairings within the range of 0.2 to 0.5 pixel widths are used, with optimal spacing at 0.35 pixel widths.

5 Claims, 7 Drawing Sheets

PAIRING OF INK DROPS ON A PRINT MEDIUM

TECHNICAL FIELD

This invention relates to ink-jet printers and more particularly to an apparatus and method for placing phase change ink drops on media, including paper and transparency film, in patterns conducive to consistent color saturation and rectilinear light transmission.

BACKGROUND ART

The field of ink-jet printing is replete with references describing solutions to problems associated with placing ink drops on a print medium. In particular, color ink-jet printing requires careful placement of ink drops to meet print resolution and color fidelity requirements without producing undesired printing artifacts such as banding, streaking, bleeding, puddling, and chroma shifting.

Ink drop placement-related problems vary in severity with a large number of printer-related variables including desired printing speed, print head array configurations, bidirectional versus unidirectional printing, transfer versus direct printing, aqueous versus phase change ink, the printing resolution required, print postprocessing employed, if any, and the type of print medium employed. Solutions to the above-mentioned problems are often associated with particular sets of printing techniques, such as: print interlacing to avoid banding and streaking artifacts; dithering patterns to improve printed image color gamut and gray scale; ink color laydown patterns to reduce bleeding and puddling; ink color laydown sequences to compensate for printing direction and color shifts; ink drops sizes and cross-sectional profiles adapted for particular print medium types and print processing techniques; specialized print media compatible with particular inks; and print postprocessing to improve printed image durability, appearance, and projectability. Many prior print interlacing methods and print head nozzle array patterns are known because of the correspondingly wide variety of nozzle array configurations, ink types, print media supports, print head and media movement mechanisms employed by ink-jet printers. Interlacing methods may be further classified into band and line interlacing methods.

Color band interlacing refers to the partial overlapping of a first printed band of a color with a subsequent printed band of the same color. This also requires line interlacing and results in the spacing apart of any printing defects due, for example, to a defective ink jet in an array of ink jets.

Line interlacing entails printing adjacent lines of dots of a particular color during sequential scans of the print head. For example, lines 1, 3, 5, etc., are printed during a first scan, and lines 2, 4, 6, etc., are printed during the next scan. In a bidirectional printer, it is desirable to print during both scanning directions. Line interlacing causes printing errors and related image defects that are dependent on the scanning direction to be generated at a high spatial frequency that is the inverse of the spacing between lines. Such defects are not easily perceived by a human eye.

It is also known that the ink color laydown sequence is important and depends on the print head scanning direction, ink composition, and time between depositing successive drops. To reduce hue-related printing artifacts, ink laydown sequences should always be the same regardless of scan direction. If this is not possible, an alternative is to alternate the ink laydown sequences on adjacent lines so that the resulting hue variations will have a high spatial frequency that is not easily perceived by the human eye.

In some instances, prior workers have sought solutions to a common printing problem but have reached contradictory solutions. For example, when printing with phase change ink, some workers teach that print quality is optimized when adjacent ink drops are allowed to melt together, or coalesce, and other workers teach that adjacent ink drops should not coalesce.

Teaching that adjacent ink drops should coalesce is found in U.S. Pat. No. 5,075,689 issued Dec. 24, 1991 for BIDIRECTIONAL HOT MELT INK JET PRINTING, which describes a phase-change ink-jet printer in which printed color hue is dependent on the order in which inks are deposited one on top of the other. If a first colored ink drop is deposited and a second colored ink drop is deposited on top of the first drop, a particular color is created. But if the ink color laydown sequence is reversed, a slightly different color is created. The patent proposes depositing both drops in such a short time period that they remain in a liquid state that allows their colors to mix together prior to setting. However, this solution is not satisfactory for all phase-change inks, especially those having high chromaticity. Moreover, because pairs of liquid drops that coalesce form a larger resultant drop than that in which the second drop is deposited on top of a set drop, color hue shift effects are still noticeable.

The contradictory teaching is found in U.S. Pat. No. 5,070,345 issued Dec. 3, 1991 for INTERLACED INK JET PRINTING which characterizes many of the banding and seaming problems associated with phase-change ink-jet printing and describes guidelines for minimizing those problems by preventing adjacent ink drops from coalescing. The guidelines state that banding can be minimized if adjacent dot rows are not printed during the same pass, and each dot row should be deposited between either unprinted adjacent dot rows or deposited between adjacent printed dot rows. Thereby, printing artifacts caused by ink blending and thermal unbalance problems are minimized.

Other workers have proposed ink drop laydown patterns as solutions to particular print quality problems. For example, U.S. Pat. No. 4,967,203 issued Oct. 30, 1990 for INTERLACE PRINTING PROCESS and U.S. Pat. No. 4,999,646 issued Mar. 12, 1991 for METHOD FOR ENHANCING THE UNIFORMITY AND CONSISTENCE OF DOT FORMATION PRODUCED BY COLOR INK JET PRINTING describe color liquid ink-jet printing methods in which predetermined ink drop patterns are employed to reduce liquid ink bleeding, coalescence, hue shift, and banding problems on transparency, plain paper, and special media. The patents describe staggering and alternating the ink drop laydown patterns such that overlapping liquid ink dots are allowed to dry because they are printed on alternate passes of a print head. Also described are "super pixels" of four pixels each whereby printed color hue is improved by employing predetermined ink color laydown and drying sequences for each super pixel.

Another ink drop laydown pattern is described in European Pat. Application No. 0 476 860 A2 published Mar. 25, 1992 for INK DROP PLACEMENT FOR IMPROVED IMAGING in which liquid ink-jet images are improved by printing groups of adjacent drops as clusters of overlapping ink drops that uniformly coalesce toward the center of each cluster. The ink drop cluster pattern substantially eliminates random ink drop coalescence that causes a mottled image. Such mottling is particularly observable when printing on transparency films.

Still other workers have proposed image postprocessing as a solution to transparency print quality problems. In particular, phase change ink-jet printing on transparency film causes individual ink drops to solidify into a lens-like shape that disperses transmitted light rays, resulting in a very dim projected image. This problem is generally solved by postprocessing the phase change ink image with some combination of temperature and pressure to flatten the ink drops. For example, U.S. Pat. No. 4,889,761 issued Dec. 26, 1989 for SUBSTRATES HAVING A LIGHT-TRANSMISSIVE PHASE CHANGE INK PRINTED THEREON AND METHODS FOR PRODUCING SAME, which is assigned to the assignee of this application, describes passing a print medium through a nip formed between two rollers at a nip pressure of about 3,500 pound/inch$^2$ ("psi") to flatten the ink drops and fuse them into the pores and fibers of the print medium. Controlled pressure in the nip flattens the ink drops into a pancake shape to provide a more light-transmissive shape and to achieve a degree of drop spreading appropriate for the printer resolution. The roller surfaces may be textured to emboss a desirable reflective pattern into the fused image. Unfortunately, such rollers are expensive, bulky, may provide nonuniform fusing pressure, and can cause print medium deformations.

Printing on transparency film also suffers from ink-related problems. The dye concentration in many inks is limited by environmental and health concern-induced regulations. For transparent inks, such as phase change inks, a dye concentration suitable for adequately color-saturated plain paper images will produce a half saturated, washed-out appearing image on transparency film. This is because with plain paper, light passes through the image, reflects off the paper and back through the image, making two passes through the ink whereas with transparency film light makes a single pass through the ink. A prior solution is to print the transparency image twice to increase the color saturation. Unfortunately, such multilayer phase change ink images can be unsuitable for use because the secondary colors are distorted, banded, bumpy, and have ink strands and multiple pixel displacements that can occur during transfer printing or image postprocessing.

Multilayer printing with phase change inks is also a problem on nontransparent print media because of secondary color bands that result from poor registration of overlayed ink drops. For example, a blue primary color is produced by exactly registering a drop of magenta ink and a drop of cyan ink. To the degree the drops are misregistered, the nonoverlapping portions of the magenta and cyan ink drops will be visible.

Clearly, the above-described mix of problems has a large number of prior solutions, some of which are contradictory and depend on the particular combination of printing technology employed.

What is needed, therefore, is a color ink-jet printing apparatus and method that provide high color-saturation image printing on transparency film and other print media without visible color shifts, image artifacts, or significant light dispersal, and without requiring image postprocessing.

SUMMARY OF THE INVENTION

It is therefore an object of the present invention to provide an improved apparatus and a method that prints consistent secondary color fills with decreased banding and streaking.

An object of this invention is, therefore, to provide an improved apparatus and a method that prints substantially light-transmissive multilayer phase change ink images on transparency film and on nontransparent media with high color saturation.

Another object of this invention is to provide an apparatus and a method that prints high-quality phase change ink images without requiring image postprocessing.

A further object of this invention is to provide an apparatus and a method that alters the addressable positioning and the pre-transfer shape and size of jetted phase change ink drops forming an image.

A still further object of this invention is to provide an apparatus and a method that reduces the sensitivity to dot-on-dot primary color placement when subtractively printing secondary colors.

Accordingly, this invention provides controllable scan line positioning offsets that causes pairing of adjacent phase change ink drops deposited by an ink-jet print head onto a print medium to form a resultant ink drop shape suitable for reducing color artifacts in multilayer printing and transparency projection applications.

In an embodiment of this invention, an image transfer ink-jet printer employs an image receiving drum that rotates relative to a phase change ink-jet array print head spanning the full width of the drum. A first series of scan lines are printed spaced apart from each other at two pixel width increments. A second series of scan lines also are printed spaced apart from each other at two pixel width increments. The first and second series of scan lines are interlaced with each other, with adjacent pairs of scan lines being spaced apart substantially closer than one pixel width.

As a feature of the invention, the spacing of adjacent pairs of scan lines is within the range of 0.2 to 0.5 pixel widths, with 0.3 to 0.4 pixel widths being preferred.

According to another aspect of the invention, a printer having a nozzle array print head has nozzles spaced apart at n pixel widths. These nozzles print a set of scan lines and the nozzle array is moved two pixel widths with respect to the print medium. This printing and moving is repeated until the nozzle array print head has been moved a total of the internozzle distance n+1. The print head is then moved a small distance in one of two opposing directions such that the next scan line to be printed is offset to be closely spaced with the adjacent scan line already printed. The process of printing a scan line and moving two pixel widths is repeated until further movements of the print head would move it more than twice the total internozzle distance from its starting position.

As a feature of the invention, the pairing of adjacent scan lines is done at a distance within the range of 0.2 to 0.5 pixel widths, with 0.3 to 0.4 pixel widths being preferred.

These and other features, advantages, and objects of the present invention will become apparent to those skilled in the art upon consideration of the following detailed disclosure of the invention, especially when taken in conjunction with the accompanying drawings.

DETAILED DESCRIPTION OF THE PREFERRED EMBODIMENT

Figure 1:
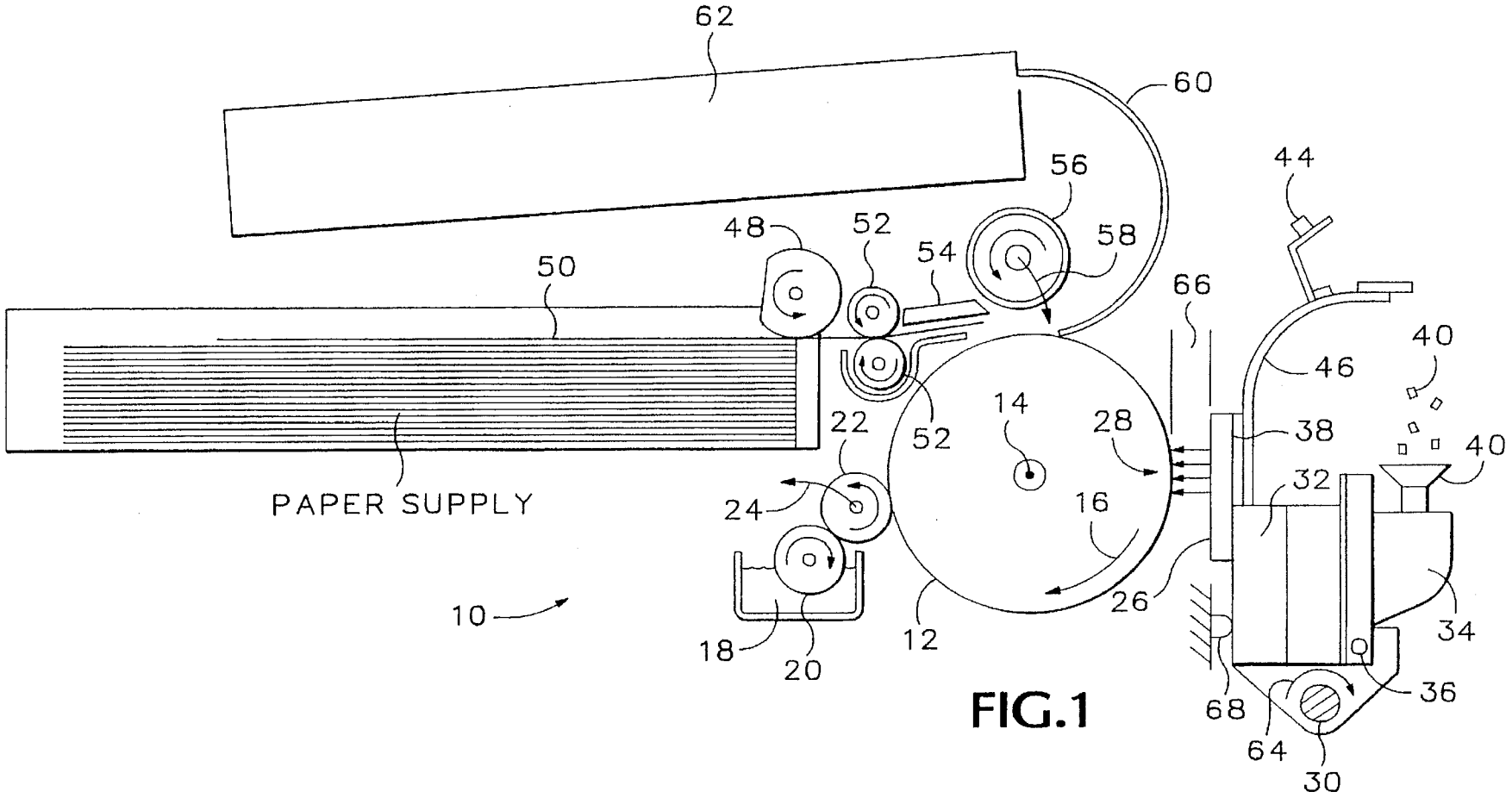
FIG. 1 is a simplified side pictorial view showing an image transfer ink-jet printer, such as one employing this invention.

FIG. 1 shows a transfer printing phase-change ink-jet printer 10 (hereafter "printer 10") that is but one type of ink-jet printer suitable for use with this invention. Printer 10 is described in co-pending U.S. Pat. No. 5,488,396 for PRINTER PRINT HEAD POSITIONING APPARATUS AND METHOD, which is assigned to the assignee of this application and which is incorporated herein by reference. Printer 10 prints an image according to the following sequence of operations.

A transfer drum 12 rotates about an axis of rotation 14 in a direction indicated by arrow 16. Prior to printing, drum 12 is wetted with a transfer fluid 18 by transfer fluid applicator rollers 20 and 22 after which transfer fluid applicator roller 22 is moved away from drum 12 in a direction indicated by arrow 24. Alternatively, transfer fluid 18 may be selectively applied to drum 12 with a movable wick (not shown). An ink-jet print head 26 spans the width of drum 12 with four vertically spaced apart nozzle arrays (shown generally at 28). Nozzle arrays 28 eject, respectively, yellow Y, cyan C, magenta M, and black K phase-change ink. (When necessary hereafter, numbered elements will be further identified by a letter indicating the color of ink carried by the element. For example, nozzle array 28C is a cyan ink ejecting nozzle array.)

Nozzle arrays 28 each have nozzles spaced apart horizontally by 2.37 millimeters (28×0.0847 millimeter pixel spaces) in support of a nominal 118 dots per centimeter printing resolution. Thus, the internozzle spacing is 28 pixel widths. Each array of nozzle arrays 28 is aligned parallel with axis of rotation 14, and nozzle arrays 28Y, 28C, and 28M are aligned vertically such that corresponding nozzles in each array print on a same scan Nine. Nozzle array 28K is offset horizontally by two pixel spaces from corresponding nozzles in the other arrays.

Figure 2:
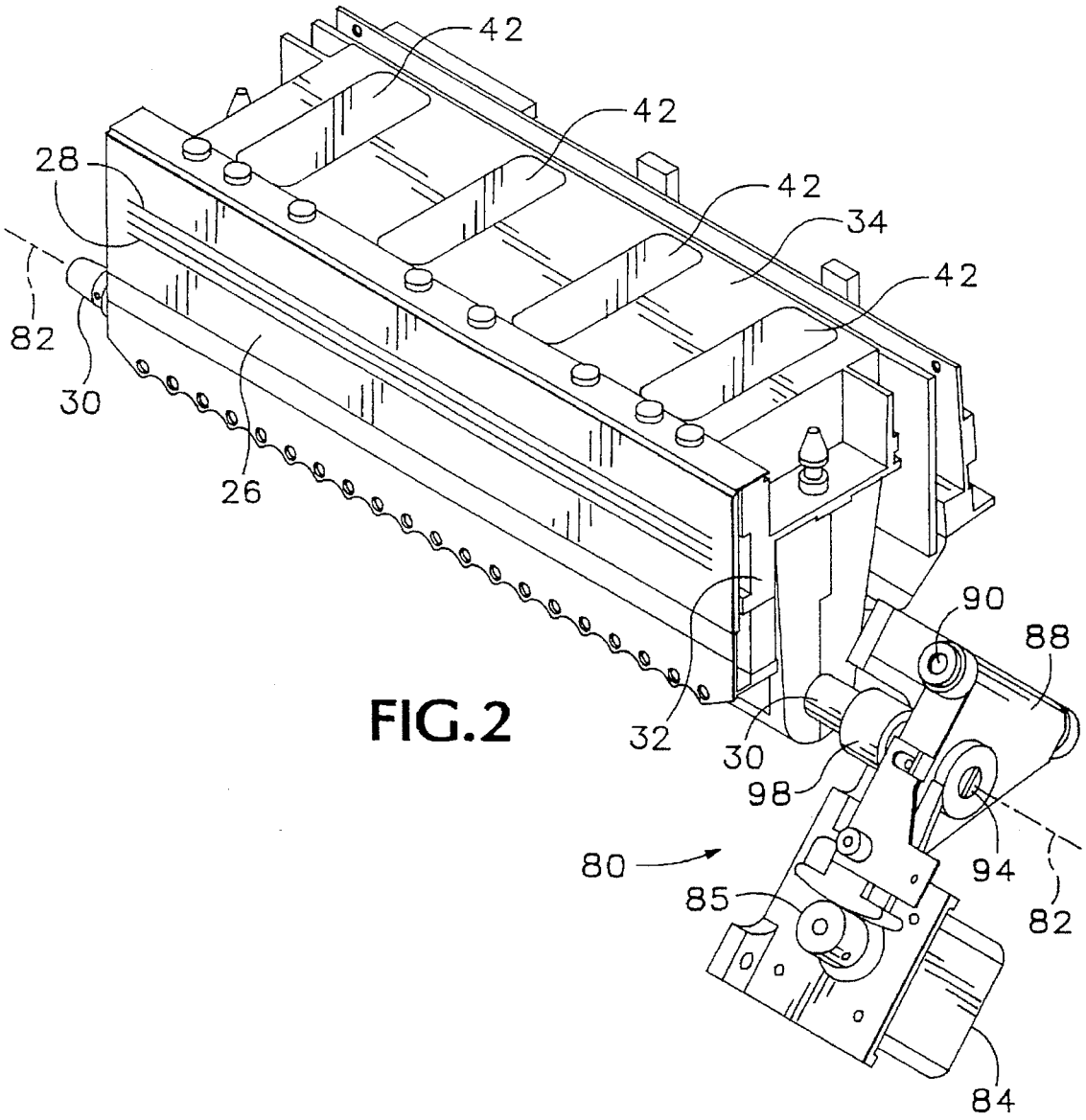
FIG. 2 is an isometric pictorial diagram showing a print head positioning mechanism of the ink-jet printer of FIG. 1.

Referring now to FIG. 2, print head 26, preferably a type that ejects phase-change ink, is mounted to an ink reservoir 32, which together with four ink premelt chambers 34, is secured to shaft 30. Reservoir 32 and premelt chambers 34 are heated by a reservoir heater 36, and print head 26 is separately heated by a print head heater 38. Four colors of solid phase-change inks 40 are fed through four funnels 42 to premelt chambers 34 where solid inks 40 are melted by reservoir heater 36 for distribution to print head 26.

Piezoelectric transducers positioned on print head 26 receive image data from drivers 44 mounted on a flex circuit 46. Print head 26 ejects controlled patterns of cyan, yellow, magenta, and black ink toward rotating drum 12 in response to the image data, thereby depositing a complete image on the wetted surface of drum 12 during 27 sequential rotations of drum 12. Repeating this process allows multiple ink layers to be placed on top of each other on the wetted surface of drum 12 to obtain greater color saturation when the image is transferred to a transparent substrate or transparency film type of print media.

A media feed roller 48 delivers a print medium 50 to a pair of media feed rollers 52, which advance print medium 50, such as plain paper or transparency film, past a media preheater 54 and into a nip formed between drum 12 and a transfer roller 56. Transfer roller 56 is moved into pressure contact with drum 12 as indicated by an arrow 58. A combination of pressure in the nip and heat from print medium 50 causes the deposited image to transfer from drum 12 and fuse to print medium 50. Image transferring heat is also provided by heating drum 12. Printed print medium 50 advances into an exit path 60 from which it is deposited in a media output tray 62.

After the image transfer is completed, transfer roller 56 moves away from drum 12 and transfer fluid applicator roller 22 moves into contact with and conditions drum 12 for receiving another image.

Figure 3:
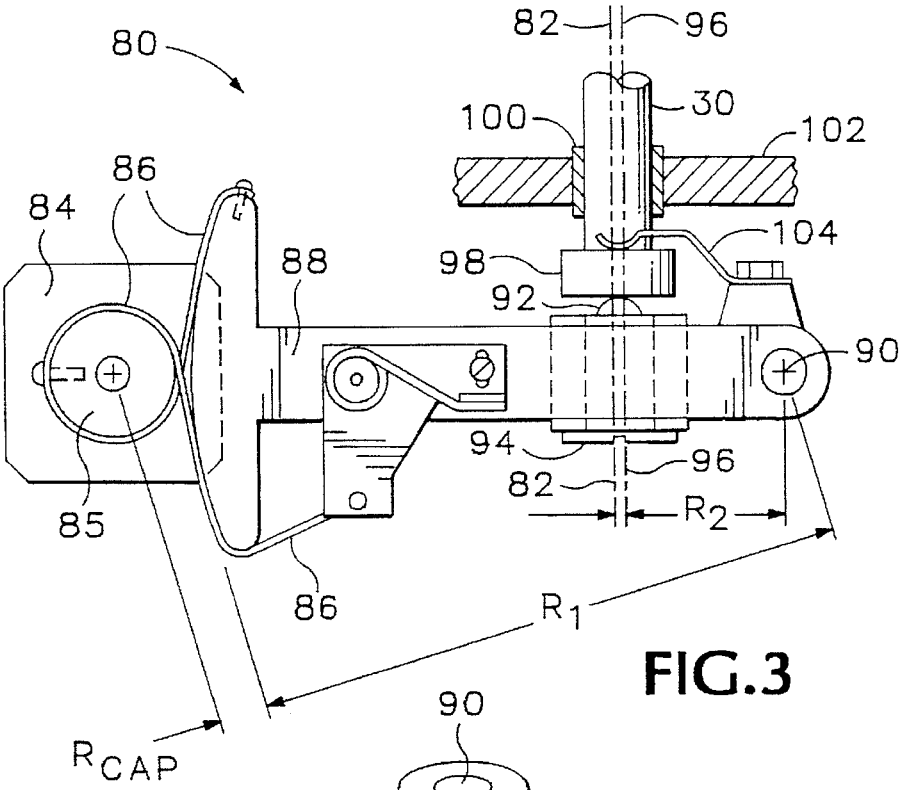
FIG. 3 is a top pictorial view showing the operative geometric relationships among a stepper motor, capstan, taut metal band, lever arm, and shaft employed by the print head positioner of FIG. 2.
Figure 4:
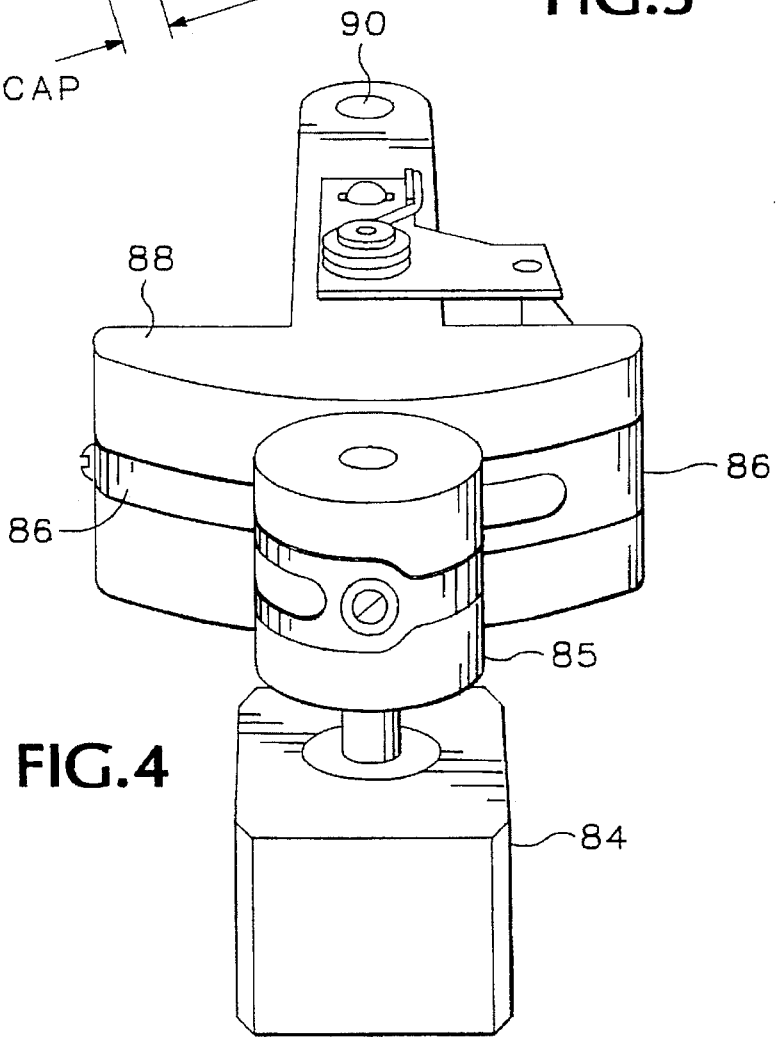
FIG. 4 is an isometric pictorial view of print head positioner components of FIG. 8 showing how the taut metal band couples the stepper motor to the lever arm.

Referring to FIGS. 2–4, a print head positioner 80 laterally moves print head 28 incrementally along a longitudinal axis 82 of shaft 30. A stepper motor 84 is coupled by a capstan 85 and a taut metal band 86 (hereafter "band 86") to a lever arm 88 that rotates on a pivot shaft 90. Lever arm 88 includes a ball contact 92 mounted in an eccentric drive 94 such that a ball axis 96 is minutely positionable relative to longitudinal axis 82 by rotating eccentric drive 94. Rotationally angular increments of stepper motor 84 are converted to corresponding angular increments of lever arm 88 and thereby to corresponding lateral translational movements of shaft 30 by means of ball contact 92. The end of shaft 30 adjacent to lever arm 88 includes a hardened metal flat 98 that abuts ball contact 92. Shaft 30 slides in a shaft bearing 100 that is mounted in a mounting plate 102. A keeper spring 104 biases shaft 30 toward ball contact 92 to maintain contact therewith.

Stepper motor 84 is preferably a two-phase hybrid stepper motor, such as model PK-224 manufactured by Oriental Motors Co., Takamatsu, Japan, which provides 200 1.8-degree steps per revolution.

Specific dimensions for lever arm radii $R_1$ and $R_2$ are chosen, and $R_2$ is adjustable such that one incremental step of stepper motor 84 equals one pixel space. Capstan 85-is pressed on the shaft of stepper motor 84, positioned to minimize runout with respect to the rotational axis of stepper motor 84, and secured with a fixing compound, such as Loctite* compound.

The scale factor is adjustable by rotating eccentric drive 94 in lever arm 88 to vary the position of ball axis 96, thereby changing the ratio of $R_1$ to $R_2$. The preferred maximum offset of ball axis 96 in either direction from longitudinal axis 82 is 0.635 millimeters (0.025 inch).

Print head positioner 80 is shown in its nominally centered position. However, a printing cycle normally begins with shaft 30 translated by lever arm 88 to a starting end of its travel that is associated with an index position. The index position may be detected by one of many conventional means, such as a microswitch or electro-optical sensor coupled to stepper motor 84, lever arm 88, shaft 30, or print head 28.

Printing an image pattern on drum 12 entails moving the print head 26 in 27 increments (one for each rotation of drum 12) in a direction parallel to the axis of rotation 14.

In one mode of printing, adjacent lines of pixels are printed sequentially. Thus, the print head 26 moves a single pixel width for each line of pixels, resulting in a total of 27 pixels in printing an image on drum 12.

In another mode of printing, the image is deposited on the drum 12 in an interlaced fashion. The 27 increments include 13 two-pixel increments, followed by one three-pixel increment, and then 13 more two-pixel increments. After the first 13 two-pixel increments, one-half of the lines of the image have been printed. The three-pixel increment advances the print head 26 to the next empty scan line, Whereupon the next 14 lines are printed. The 27 increments together move print head 26 a total lateral distance of 55 pixels (4.656 millimeters), which is one pixel short of twice the inter-nozzle spacing. In this interlaced mode, different nozzles print adjacent lines of ink drops.

The required lateral movement is accomplished by securing print head 26 (and associated components) to a shaft 30 that is moved laterally by a print head positioner 80. Precise positioning is accomplished using the well-known technique of microstepping.

Prior art printers follow the conventional wisdom that scan lines of ink drops must be deposited on a print medium at addressable positions represented by a uniformly spaced grid pattern. Indeed, great care is typically taken to ensure the uniform positioning of the ink drops.

Figure 5:
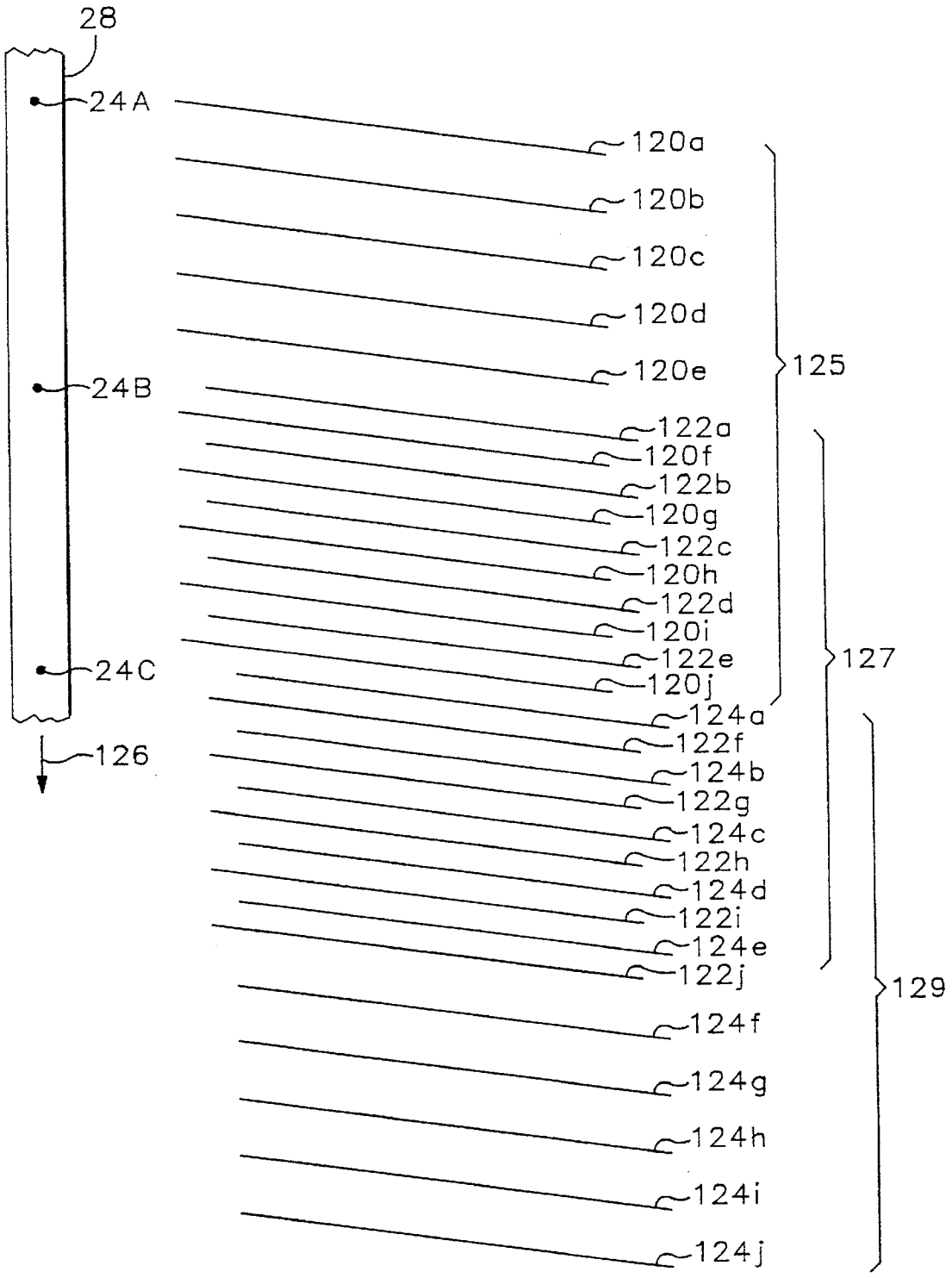
FIG.5 (PRIOR ART)
FIG. 5 is an enlarged schematic pictorial view representing three adjacent ink-jet nozzles moved respectively in evenly-space increments to print interlaced bands of ink on a print medium.

Referring now to FIG. 5, a portion of a nozzle array 28 is shown. To simplify the drawing, the inter-nozzle spacing is 10 pixel widths rather than 28 pixel widths as described above. During a first drum rotation, nozzles 24A, 24B, and 24C print respective first scan lines 120*a*, 122*a*, and 124*a*, after which nozzle array 26 is moved exactly two pixel widths in the direction indicate by arrow 126. Alternatively and preferably, nozzle array 26 is smoothly moved by two pixel widths during the time of each drum rotation. During a second drum rotation, nozzles 24A, 24B and 24C print respective second scan lines 120*b*, 122*b*, and 124*b* after which nozzle array 26 is again moved exactly two pixel widths. This process repeats eight more times until during a tenth drum rotation nozzles 24A, 24B, and 24C print respective tenth scan lines 120*j*, 122*j*, and 124*j* after which nozzle array 26 returns to its original starting position.

It should be recognized that between the fifth and sixth scan lines 120*e*, 120*f* for the first nozzle 24A, the nozzle array 26 moves exactly three pixel widths to the next available empty scan line.

The ten successive scan lines printed by nozzles 24A, 24B and 24C form respective first through third print bands 125, 127, and 129. The print bands are shown laterally offset to clearly differentiate them from each other.

Figure 6:
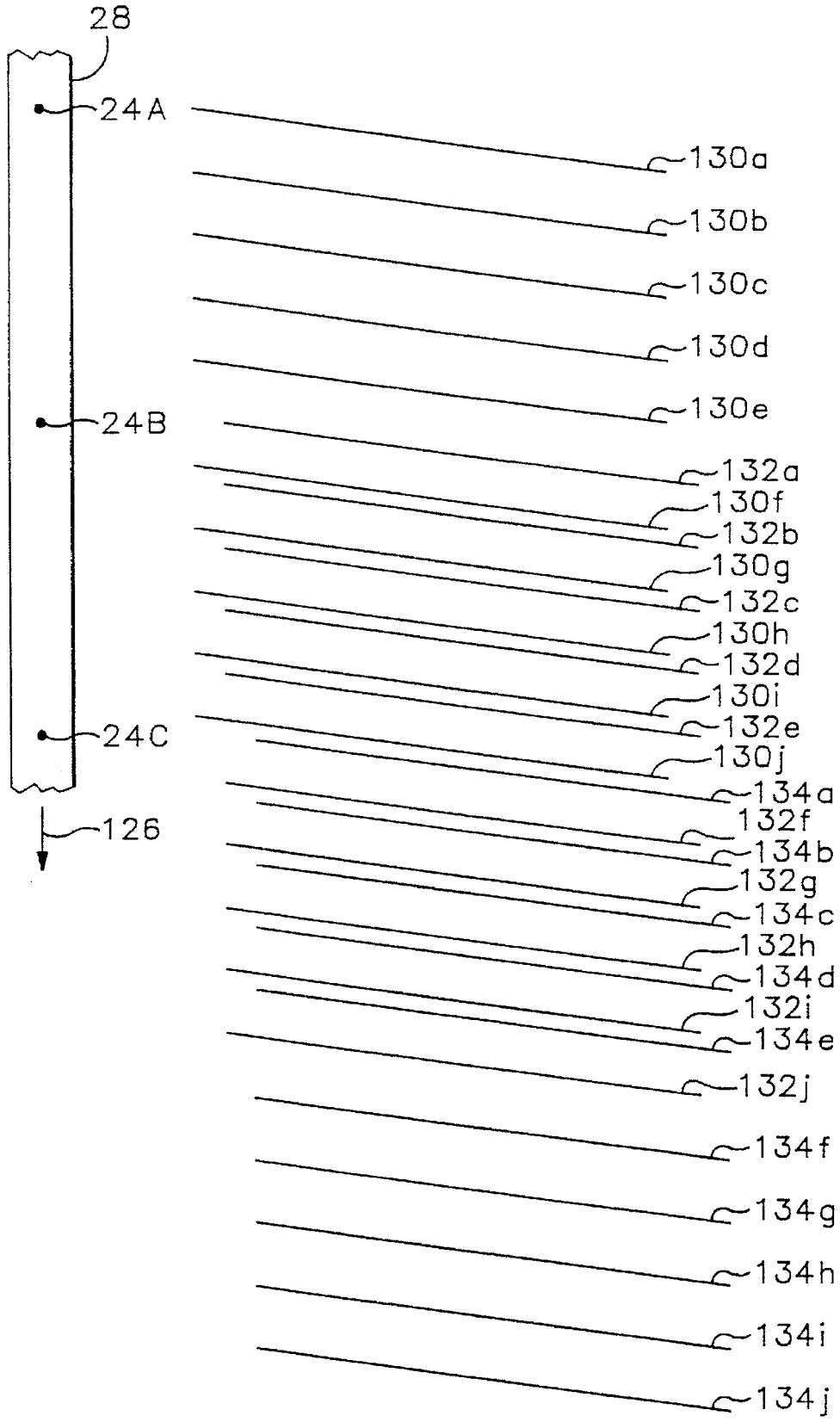
FIG. 6 is an enlarged schematic pictorial view representing three adjacent ink-jet nozzles moved respectively in increments to print paired interlaced bands of ink on a print: medium.

Referring now to FIG. 6, according to the present invention, scan lines are intentionally "paired" by spacing two adjacent scan lines at less than one nominal pixel width.

As for the example of FIG. 5, the inter-nozzle spacing is 10 pixel widths. During a first drum rotation, nozzles 24A, 24B, and 24C print respective first scan lines 130*a*, 132*a*, and 134*a*, after which nozzle array 26 is moved exactly two pixel widths in the direction indicate by arrow 136. During a second drum rotation, nozzles 24A, 24B and 24C print respective second scan lines 130*b*, 132*b*, and 134*b* after which nozzle array 26 is again moved exactly two pixel widths. This process repeats eight more times until during a tenth drum rotation nozzles 24A, 24B, and 24C print respective tenth scan lines 130*j*, 132*j*, and 134*j* after which nozzle array 26 returns to its original starting position.

According to the present invention, between the fifth and sixth scan lines 130*e*, 130*f* for the first nozzle 24A, the nozzle array 26 moves a distance other than three pixel widths. In a preferred embodiment, the distance is 3.35 pixel widths, thereby causing the sixth through tenth scan lines 130*f*–130*j* of the first nozzle 24A to be closely spaced (or "paired") with the first through fifth scan lines 132*a*–132*e* of the second nozzle 24B. That is, the spacing between adjacent interlaced scan lines is 0.35 pixel widths.

Skilled workers will recognize that a movement of the nozzle array 26 of 2.65 pixel widths between the fifth and sixth scan lines 130*a*, 130*f* for the first nozzle 24A will also result in a pairing of adjacent scan lines.

This intentional pairing of adjacent scan lines by offsetting the next scan line a small distance causes the adjacent scan lines to be closely spaced and results in increased consistency of secondary color fills with virtually no banding or streaking. It is believed this results from the averaging of individual variations in scan line positions.

Through testing, a spacing of 0.3 to 0.4 pixel widths for paired scan lines has been found to be optimal. Improvement in print quality was detected over the broader range of 0.2 to 0.5 pixel widths, however.

Figure 7:
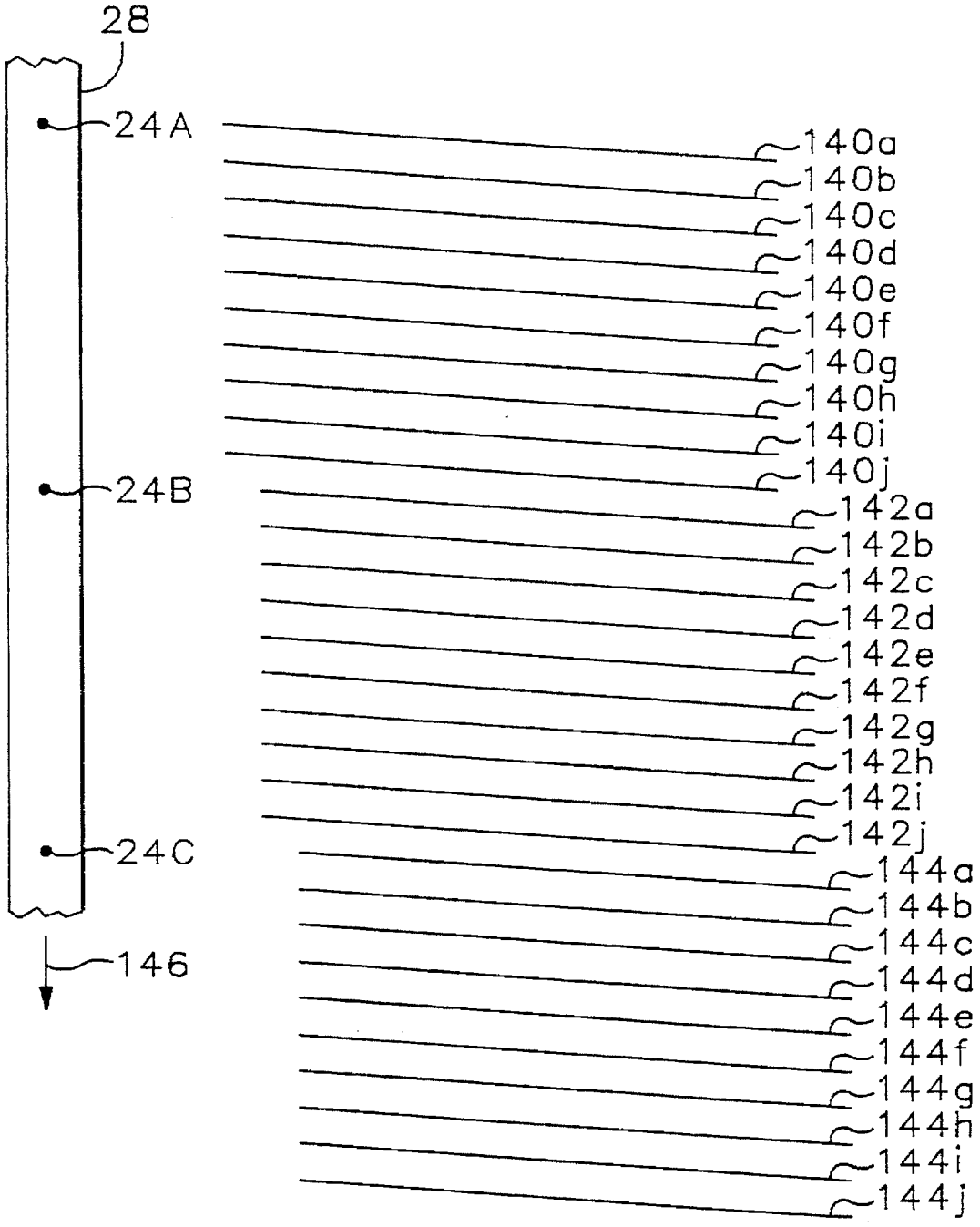
FIG.7 (PRIOR ART)
FIG. 7 is an enlarged schematic pictorial view representing three adjacent ink-jet nozzles moved receptively in increments intended to print bands of ink on a print medium.

It is expected that pairing of scan lines according to the present invention will also provide increased consistency for non-interlaced printing. Referring now to FIG. 7, conventional non-interlace printing spaces scan lines 140*a*–144-*j* at equal one-pixel width intervals. Thus, for a first rotation of drum 12, nozzles 24A, 24B, and 24C print scan lines 140*a*, 142*a*, and 144*a*, respectively. The nozzle array 28 is then moved one pixel width in the direction represented by arrow 146 whereupon nozzles 24A, 24B, and 24C print scan lines 140*b*, 142*b*, and 144*b*, respectively. Each nozzle prints 10 scan lines to complete the image.

Figure 8:
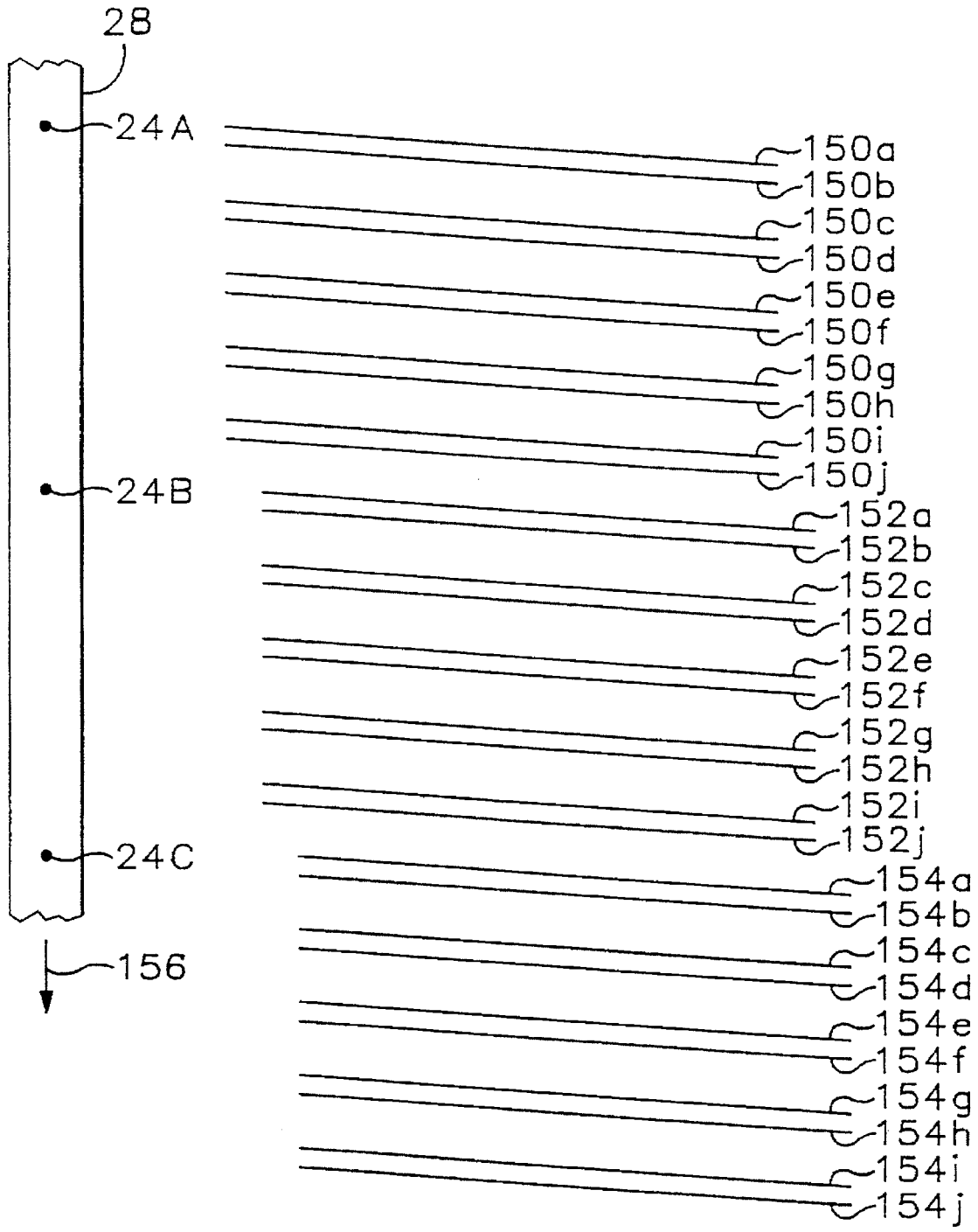
FIG.8 (PRIOR ART)
FIG. 8 is an enlarged schematic pictorial view representing three adjacent ink-jet nozzles moved respectively in increments to print paired bands of ink on a print medium.

Referring to FIG. 8, intentional pairing of scan lines may also be accomplished in non-interlaced printing. For a first rotation of drum 12, nozzles 24A, 24B, and 24C would print scan lines 150*a*, 152*a*, and 154*a*, respectively. The nozzle array 28 would then be moved a distance less than one pixel width in the direction represented by arrow 156 whereupon nozzles 24A, 24B, and 24C would print scan lines 150*b*, 152*b*, and 154*b*. The nozzle array 28 would be moved a distance greater than one pixel width to the beginning of the next scan line. The distances moved for two adjacent scan lines must equal exactly two pixel widths. It is expected that movements of approximately 0.35 and 1.65 pixel widths would provide optimal results.

While not tested, it is anticipated that a different amount of spacing might be optimal for each printed color and/or for each media type. It is, therefore, preferred that the spacing value be programmable.

The desirable coalescence properties of this invention are exhibited most notably by phase change inks because of their relatively high viscosity, adhesive properties, and state changes as a function of the rate of ink temperature change. Phase change ink compositions particularly suitable for use with this invention are described in U.S. Pat. No 4,889,560 issued Dec. 26, 1989 for PHASE CHANGE INK COMPOSITION AND PHASE CHANGE INK PRODUCED THEREFROM and co-pending U.S. Pat. No. 5,372,852 for PROCESS FOR APPLYING SELECTIVE PHASE CHANGE INK COMPOSITIONS TO SUBSTRATES IN INDIRECT PRINTING PROCESSES, both of which are assigned to the assignee of this application and incorporated herein by reference. Of course, the invention is not limited to these ink compositions, and other ink compositions, including liquid inks, could also be used to achieve various print quality improvements.

Skilled workers will recognize that portions of this invention may have alternative embodiments. For example, this invention may also be used in direct image transfer printing, bidirectional printing, liquid ink printing, or plain paper printing. The image receiving scan lines may be traced by a single nozzle ink-jet print head or by any operable nozzle array configuration of an ink-jet print head. Printing may be accomplished by any means that moves a print head relative to an image receiving surface, such as a bidirectionally scanning print head moving relative to a stationary print medium. The invention is applicable to a variety of print interlacing schemes and to non-interlaced printing as well, whether the offset distance is in a horizontal, vertical or diagonal direction.

Of course, image postprocessing may still be employed with this invention to provide additional control over final printing quality.

It will be obvious to those having skill in the art that many changes may be made to the details of the above-described embodiments of this invention without departing from the underlying principles thereof. Accordingly, it will be appreciated that this invention is also applicable to ink drop placement and mechanism positioning applications other -than those found in phase change ink-jet printers. The scope of the present invention should, therefore, be determined only by the following claims.

What is claimed is:

1. A method for positioning ink drops on a print medium in an ink-jet printer having a print head with nozzle arrays therein, the print head and the print medium having relative movement therebetween and the print head having nozzles within the nozzle arrays spaced apart at n pixel widths comprising the steps of:

(a) printing an initial set of scan lines spaced apart at least two pixel widths;

(b) moving the print head 2 pixel widths with respect to the print medium;

(c) repeating steps (a) and (b) to print subsequent sets of scan lines and correspondingly move the print head until the print head is moved a distance of n+1 pixel widths with respect to the medium;

(d) moving the print head in one of two opposing directions so a next set of scan lines printed is offset and closely spaced with an adjacent set of scan lines already printed, the next set of scan lines being interlaced with the initial set of scan lines and having a spacing between adjacent pairs of the initial set of scan lines and the subsequent sets of scan lines being less than one pixel width; and (e) repeating steps (a) and (b) until the print head is moved (2+) (n) pixel widths with respect to the print medium.

2. The method of claim 1, in which the spacing between adjacent pairs of the initial set of-scan lines and the subsequent sets of scan lines is within a range of 0.2 to 0.5 pixel widths.

3. The method of claim 2, in which the spacing between adjacent pairs of the first set of scan lines and the subsequent sets of scan lines is 0.3 pixel to 0.4 pixel widths.

4. A method for positioning ink drops on a print medium in an ink-jet printer having a print head with nozzle arrays, the print head and the print medium having relative motion therebetween and the print head having nozzles within the nozzle arrays spaced apart at n pixel widths comprising the steps of:

(a) printing a set of scan lines;

(b) moving said print head two pixel widths;

(c) repeating steps (a) and (b) n/2 times if n is an even number or (n+1)/2 times if n is an odd number;

(d) moving said print head one plus x pixel widths if n is an even number and x pixel widths if n is an odd number, where x is selected from within ranges of −0.5 to −0.2 pixel widths or 0.2 to 0.5 pixel widths; and (e) repeating steps (a) and (b) n/2 times if n is an even number or (n−1)/2 times if n is an odd number.

5. (Amended) The method of claim 4, wherein x is within a range of 0.3 to 0.4 pixel widths.

* * * * *

UNITED STATES PATENT AND TRADEMARK OFFICE

CERTIFICATE OF CORRECTION

PATENT NO. : 5,625,390
DATED : April 29, 1997
INVENTOR(S) : Edward F. Burke, Mark R. Parker and David D. Martenson It is certified that error appears in the above-indentified patent and that said Letters Patent is hereby corrected as shown below:

Claim 3, line 2 - after "the" and before "set" change "first" to --initial--.

Signed and Sealed this

Ninth Day of September, 1997

*Attest:*

Bruce Lehman

BRUCE LEHMAN

*Attesting Officer*

*Commissioner of Patents and Trademarks*